US005240393A

United States Patent [19]

Laumont

[11] Patent Number: 5,240,393

[45] Date of Patent: Aug. 31, 1993

[54] HYDRAULIC MACHINE OF THE GEAR TYPE

[75] Inventor: Roger Laumont, La Varenne Saint Hilaire, France

[73] Assignee: Hydroperfect International - HPI, Chennevieres-sur-Marne, France

[21] Appl. No.: 949,931

[22] Filed: Sep. 24, 1992

[30] Foreign Application Priority Data

Sep. 24, 1991 [FR] France ..... 91 11745

[51] Int. Cl.[5] ..... F04C 2/18

[52] U.S. Cl. ..... 418/132

[58] Field of Search ..... 418/102, 132

[56] References Cited

U.S. PATENT DOCUMENTS

| | | | |
|---|---|---|---|
| 2,691,945 | 10/1954 | Wichorek . | |
| 3,376,824 | 4/1968 | Turolla | 418/132 |
| 3,909,165 | 9/1975 | Laumont | 418/102 |
| 4,078,872 | 3/1978 | Teruyama | 418/132 |

FOREIGN PATENT DOCUMENTS

| | | |
|---|---|---|
| 0151798 | 12/1984 | European Pat. Off. . |
| 2855567 | 6/1980 | Fed. Rep. of Germany . |
| 853550 | 11/1960 | United Kingdom . |
| 1179762 | 1/1970 | United Kingdom . |
| 1311868 | 3/1973 | United Kingdom . |

*Primary Examiner*—Richard E. Gluck

*Attorney, Agent, or Firm*—Browdy and Neimark

[57] ABSTRACT

The machine includes at least one set of two cooperating pinions rotating between two mobile bearing flanges which are mobile in translation in cavities provided in a median casing closed on the two opposite sides thereof by anterior and posterior covers. Each of these two bearing flanges is substantially pressure equilibrated by a suitable sealing system arranged between this bearing flange and the adjacent cover. The bearing flanges supporting the pinions are floatingly mounted inside the median casing, and pressure means are provided to press the bearing flanges against the median casing and cause a differential pressure pressing the bearing flanges against side faces of the pinions.

15 Claims, 3 Drawing Sheets

HYDRAULIC MACHINE OF THE GEAR TYPE

FIELD OF THE INVENTION

The present invention relates to those hydraulic gear machines adapted for being used either as pumps or as motors.

In the field of high performing gear hydraulic apparatus, there have already been proposed apparatus of the type including a set of two cooperating toothed wheels mounted so as to rotate between two flanges. The two flanges form a bearing and are mounted to be mobile in translation in corresponding recesses provided in a central body and defined by two opposite covers or casings fixed in a tight manner to the central body. Each of the two flanges are substantially in pressure equilibrium by a suitable sealing system arranged between the flanges and the adjacent cover.

Such apparatuses are typically known by U.S. Pat. No. 3,909,165 and give satisfaction by providing excellent mechanical and volumetric efficiencies for an acceptable cost price, considering the performance obtained.

However, it has appeared that known apparatuses do not have the same efficiency as a function of the working temperature. This is a defect due to the variations of viscosity of the working fluid as well as to the differential expansions existing between the various parts, and more particularly between the fixed and mobile parts, as the bodies of the pumps being often made in aluminum as well as the flanges, while the pinions are in steel.

PURPOSE AND SUMMARY OF THE INVENTION

The invention aims at remedying the above disadvantages by providing a new hydraulic machine of which all the mobile parts can float with respect to the fixed parts, no matter what the operating temperature and the rotation speed of the mobile parts. Moreover the compensation pressures, which are generated and are differential pressures, maintain a constant compensation of the plays.

According to the invention, the hydraulic machine of the gear type includes at least one set of two cooperating pinions rotating between two mobile flanges. The pinions are mobile in translation in cavities provided in a median casing closed on its two opposite sides by anterior and posterior casings. Each of the two flanges are substantially pressure equilibrated by a suitable sealing system arranged between the flanges and the adjacent casing. The flanges supporting the pinions are floatingly mounted inside the median casing and pressure means are provided to press the flanges against the median casing and cause a differential pressure pressing the flanges against the side faces of the pinions.

This and other objects of the invention will become more apparent in the detailed description which follows.

DISCLOSURE OF THE PREFERRED EMBODIMENT

Figure 2:
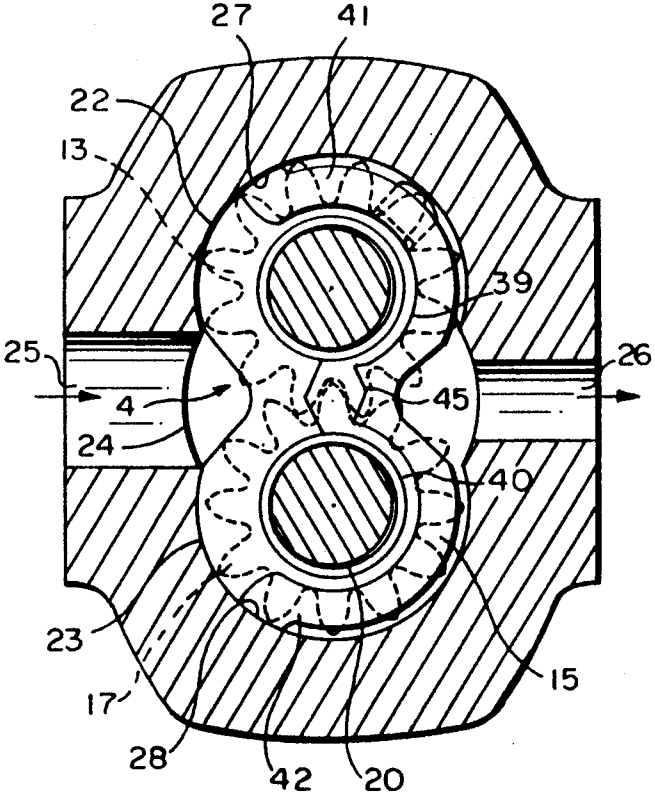
FIG. 2 is a cross sectional view taken along line II—II of FIG. 1.

In the following description, the machine which is shown as an example is described as a pump for supplying a liquid under pressure.

The same machine could however be used as a motor, its constituent elements being reversible, as this is usual in the technique of pumps or hydraulic motors of the gear type.

Also, in the following disclosure, the hydraulic machine is described with reference to a machine with a single set of gears, but this machine could, in a similar way, include several sets of gears, in particular two sets of gears having their toothings offset from one set to the other.

Generally and as typically known as such, the machine includes an anterior casing 1 or cover and a posterior casing 2 or cover, connected to one another by a median casing 3 inside which is placed, according to the invention, a floating body 4 made of two flanges for the support of shafts and pinions thereafter described.

The median casing 3 is centered with respect to the anterior casing 1 and posterior casing 2 by means of pins 5. Moreover, the anterior casing 1 and posterior casing 2 are fixed to the median casing 3 by bolts 6.

Figure 1:
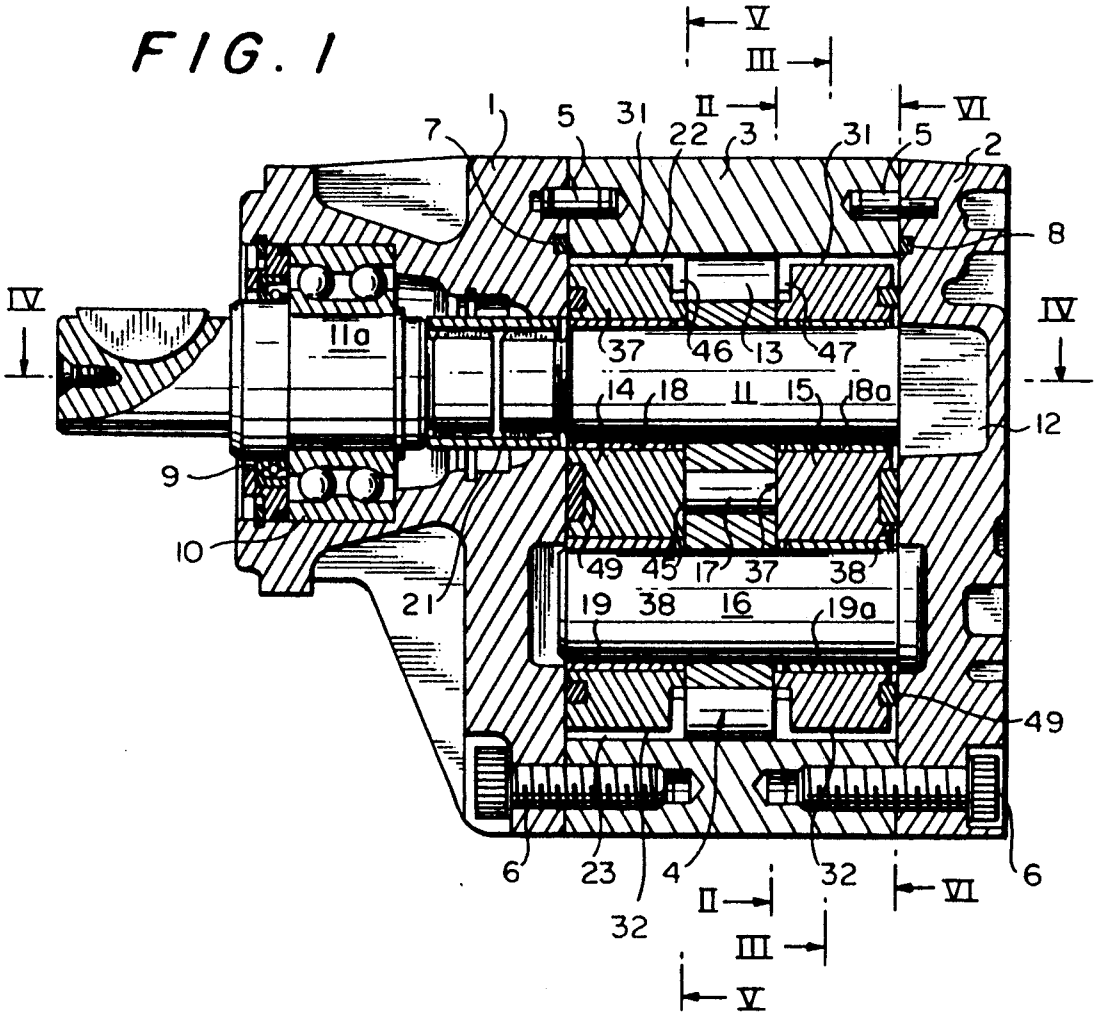
FIG. 1 is a longitudinal cross sectional view in elevation of an embodiment of the machine according to the invention.
Figure 4:
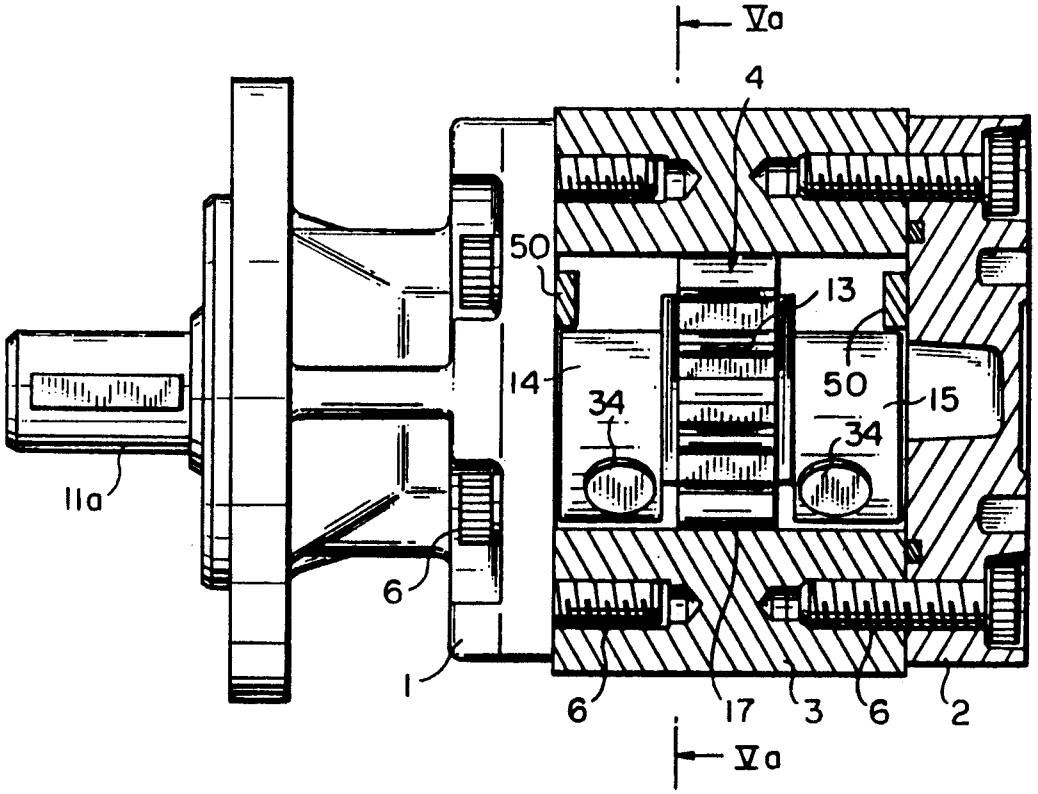
FIG. 4 is a plan view, partly in cross section, taken along line IV—IV of FIG. 1.

Sealing gaskets 7, 8 are interposed between the anterior casing 1 and the median casing 3, and between the posterior casing 2 and the median casing 3, respectively. (FIG. 1).

In the embodiment as shown, the anterior casing 1 contains a sealing gasket 9 and a bearing 10 in which is mounted an input shaft 11*a* connected by a coupling 21 to a primary shaft 11 extending inside the median casing 3 up to a housing 12 of the posterior casing 2.

The shaft 11 supports and drives a primary pinion 13 placed between a front flange 14 and a rear flange 15 making a part of the floating body 4.

The flanges 14 and 15 also support a secondary shaft 16 on which is fixed a pinion 17 meshing with the primary pinion 13.

The shaft 11 as well as the shaft 16 are supported by the flanges 14 and 15 via bushings or bearings 18, 18*a*, and 19, 19*a*, the width of which is slightly smaller than thickness of the flanges 14, 15, and in which the shafts 11 and 16 can slide in the same time as they rotate.

When the hereabove bearings are made of smooth rings, they include preferably lubrication grooves 20 advantageously made in the manner disclosed and shown in French patent 1 554 858.

The coupling 21 is such that a portion of the shaft 11 which is carried by the bearings 18, 18*a* is subjected to the same flexural stresses as the shaft 16, which equalizes the mode of operation of the two respective shafts.

In a similar way as the flanges 14, 15, the pinions 13 and 17 are mounted on the shafts 11 and 16 so as to be able to axially slide thereon.

The drawing shows that the flanges 14, 15 have both substantially the shape of a 8 figure. Likewise, the inside of the median casing 3 defines two circular cavities 22, 23 communicating with each other via a median circular cavity 24.

The radius of curvature of the circular cavities 22, 23 is the same as that of the periphery of the teeth of the primary pinion 13 and secondary pinion 17, which pinions are in mesh with one another.

Figure 5:
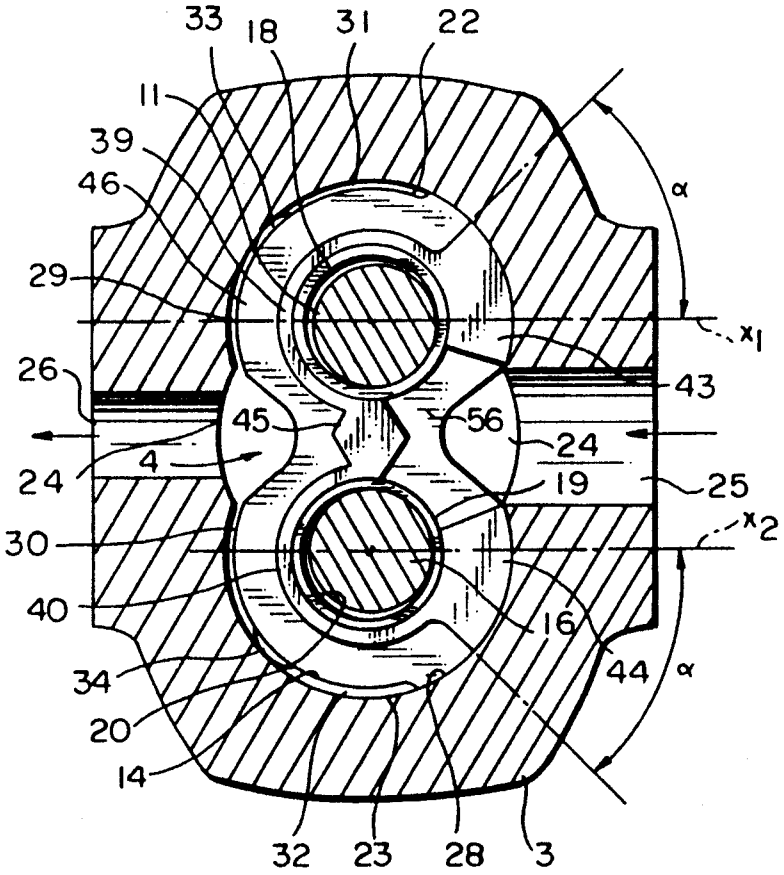
FIG. 5 is a cross sectional view taken along line V—V of FIG. 1, or line Va—Va of FIG. 4.

The median cavity 24 communicates, on the one hand, with the inlet duct 25 for the fluid to be pumped and, on the other hand, with a delivery duct 26 for the same fluid (see FIGS. 2 and 5).

Preferably, the inlet duct 25 has a cross section area which is larger than that of the delivery duct 26.

Each flange 14 and 15 is provided, in its peripheral portion, with a lobe 27, 28, respectively, of same radius as that of the corresponding cavity 22, 23, respectively, in order to bear against respective walls of each of the two cavities 22, 23.

Figure 3:
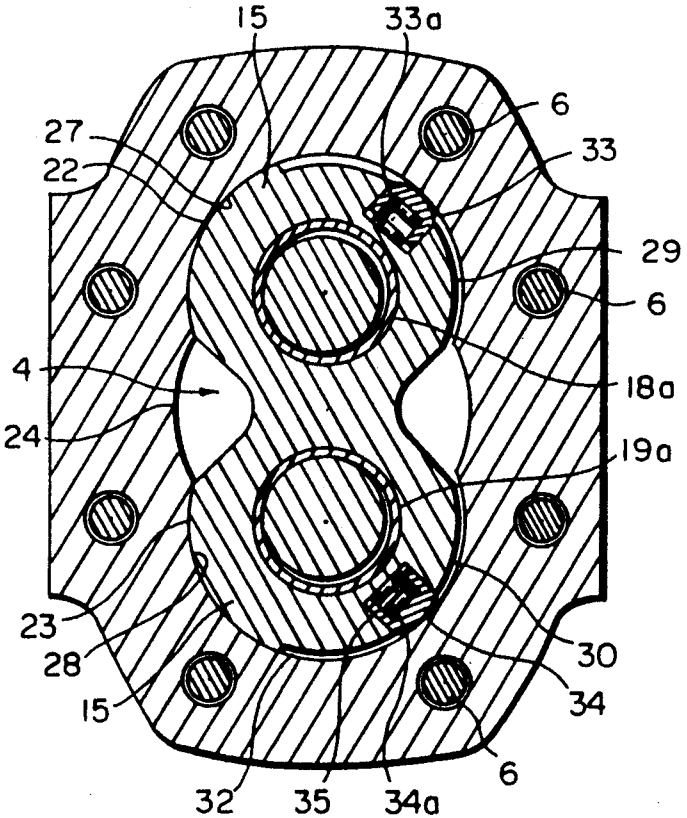
FIG. 3 is a cross sectional view taken along line III—III of FIG. 1.
Figure 6:
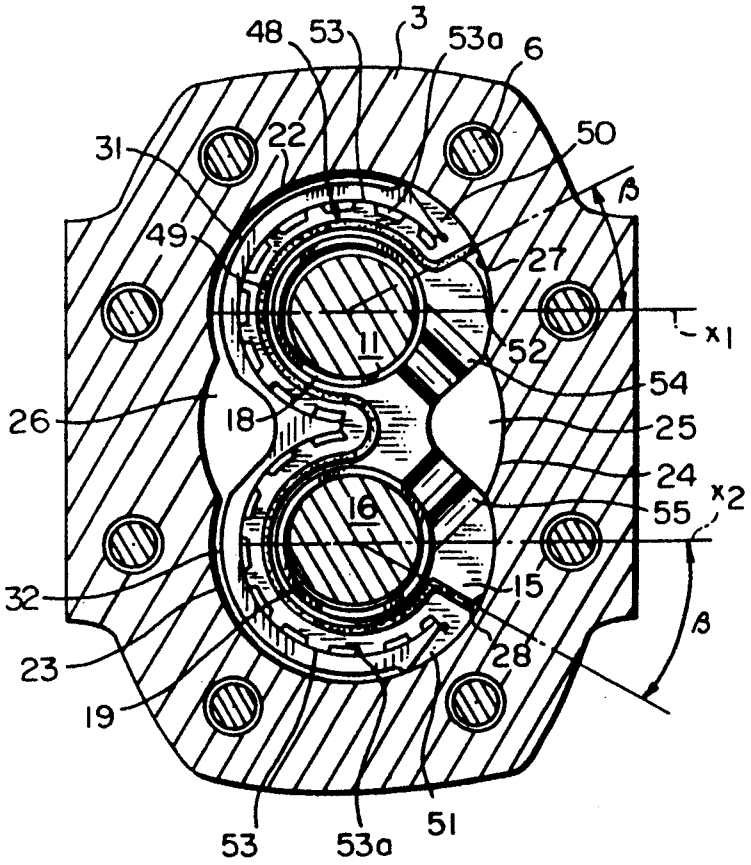
FIG. 6 is a cross sectional view taken along line VI—VI of FIG. 1.

As shown in FIG. 3, the outer wall of the front flange 14 and rear flange 15 has cut off portions 29 and 30, respectively, which are portions of smaller diameter than the lobes 27, 28, so as to provide spaces 31, 32 communicating, as shown particularly in FIGS. 2 and 6, with the delivery duct 26.

From the foregoing, it is apparent that the pressure of the fluid which is in the delivery duct 26 is applied in the spaces 31, 32 which are at the periphery of the flanges 14 and 15, the effect of which being to push the lobes 27 and 28 against the wall of the circular cavities 22, 23 when the pressure in the delivery duct 26 is higher than the pressure in the inlet duct 25, which is the case when the pump is operating.

Studs 33, 34 are disposed in the flanges 14, 15 so as to protrude inside the spaces 31, 32 as shown in FIG. 3.

The studs 33, 34 are mounted in housings 35 communicating with the spaces 31, 32 so that the pressure prevailing in these spaces is applied on both sides of the studs 33, 34 which are, on the other hand, pressed by springs **33*a*, 34*a*. The springs 33*a*, 34*a* are slightly stressed, so that they exert a thrust tending only to maintain the lobes 27, 28 of the flanges bearing against the wall of the circular cavities 22, 23**.

Since the pressure developed in the spaces 31, 32 is applied on both sides of the studs 33, 34, the studs 33, 34 are constantly in equilibrium, so that the stress that they exert on the wall of the cavities of the median casing is that arising from the calibration of the springs **33*a*, 34*a***.

With reference to FIG. 1, each flange 14 and 15 includes a front wall or face 37 facing the pinions 13 and 17, and a rear wall or face 38 facing the anterior casing 1 as regards the flange 14 and the posterior casing 2 as regards the flange 15.

In order to simplify the following disclosure, only a front wall and a rear wall will be described, the two flanges being rigorously similar.

The front wall 37 includes annular segments 39, 40 (FIGS. 2 and 5) extending from a bore containing the bearing 18 or **18*a* down to a bottom of the teeth 41 and 42 of the primary and secondary pinions 13 and 17. The segments 39, 40 form bearing surfaces for the plain portions of the pinions 13, 17. At one end, the annular segments 39, 40 are connected to plates 43, 44 of substantially trapezoidal shape and, at their other end, they are connected together via a partition wall 45 separating the inlet duct 25 from the delivery duct 26**.

FIG. 5 shows that the partition wall 45 has advantageously a shape which is substantially that of a lozenge.

FIG. 2 shows that the size of the partition wall 45, and also its shape, are determined so as to correspond to the extension occupied by at least one tooth space of the pinions 13, 17. Thus a direct communication between the inlet duct 25 and the delivery duct 26 should never be possible when the pinions are rotating.

For the same reason, the annular segments 39, 40, the plates 43, 44 and the partition wall 45 of each flange are coplanar in order to bear permanently against the pinions 13 and 17. The foregoing disclosure shows that the plates 43, 44 separate the high and low pressure zones.

The portion of the front wall 37 which should not come to bear against the side face of the pinions is milled so as to form a chamber 46 (FIG. 5) and, respectively, 47 (FIG. 1), on either side of the primary pinion 13 and secondary pinion 17.

The drawing shows that the chambers 46 and 47 communicate with the circular cavities 22, 23 and contain consequently a fluid which is at the same pressure as the pressure prevailing in the delivery duct 26.

The foregoing disclosure shows that the pressure in the chambers 46 and 47 is exerted on the whole of the side surface of the front flange 14 and rear flange 15 which is left free by the circular segments 39, 40, the plates 43, 44 and the partition wall 45.

This pressure tends in consequence to spread apart the flanges 14, 15 from the side walls of the pinions 13, 17.

The rear wall 38 of each flange is illustrated in FIG. 6 which shows that the rear wall 38 is formed with a groove 48 having substantially a shape of the letter W, and in which is placed a sealing gasket 49 ending at its both ends by retaining shoes 50, 51 (FIG. 6). In known manner, the sealing gasket 49 is provided with an anti-extrusion lining 52.

The sealing gasket 49 is formed with small bosses 53 so as to define notches **53*a* and allow the fluid, which is in the circular cavities 22, 23 and which comes against the rear wall 38 of each flange, to press the sealing gasket against the anterior casing 1 and, respectively, the posterior casing 2**, while also exerting a pressure on the rear face of each flange.

The size of the incision 48 and of the sealing gasket 49, the shoes 50 of which are disposed in the lobes 27, 28, is determined so that the surface on which is applied the pressure of the fluid coming from the delivery duct 26 is greater than the surface on which is exerted this pressure on the front face of each flange.

Thus, a differential pressure is therefore applied on the flanges, this differential pressure being always exerted in the direction for which these flanges are pressed against the circular pinions.

Moreover, it is advantageous that the sealing gasket 49, which is in the rear face of each flange, will exert itself a slight pressure so that the flanges are maintained bearing against the side faces of the pinions when the pump is not operating and that the pressure in the delivery duct 26 has a tendency to become equal to the pressure in the inlet duct 25.

In order to have the floating body 4 independent from stresses due to possible differential expansions, there is provided that the sum of the thicknesses of the flanges 14, 15 and of the pinions 13, 17 is slightly smaller than the width of the median casing 3. The centering of the floating body 4 is then ensured by the sealing gaskets 49 and by the differential pressure which presses the flanges 14, 15 toward one another against the side faces of the pinions 13 and 17.

On the other hand, the lobes 27 and 28 extend preferably over an arc of a circle which is less than 90°, the flanges 14 and 15 being prevented to rock by means of the studs 33, 34 maintaining the lobes 27 and 28 against the wall of the circular cavities 22, 23, an arrangement which allows also to compensate possible differential expansions which can appear between the flanges 14, 15 and the median casing 3.

FIG. 6 shows that the rear face of the flanges 14 and 15 has channels 54, 55 which communicate the inlet duct 25, via the cavity 24, with one end of the lubricating grooves 20 of the bushings 18, 18*a* and 19, 19*a*. On the other hand, FIG. 5 shows a recess 56 provided in the front face of the flanges 14 and 15 between the plates 43, 44 and the partition wall 45. The recess 56 places the cavity 24, which is under a low pressure, in communication with the lubricating grooves 20, so that the hydraulic fluid flows in these grooves from the recess 56 up to the channel 54 or 55, or inversely, according to the rotation direction of the shafts 1 and 16. Moreover, each recess 56 reduces the friction surface of the pinions.

In this manner, a fluid under a low pressure is brought in the bushings and beyond them in the spaces left free by the shafts 11 and 16 inside the casings 1, 2 and 3. Therefore all the inner spaces of the pump are filled with a fluid under a low pressure, with the exception of those spaces which are described in the foregoing disclosure and which are in communication with the delivery duct 26 which makes the high pressure to prevail when the pump is operating.

The fact that the spaces left free by the shafts 11 and 16 inside the casings 1, 2 and 3 are filled with a fluid under a low pressure prevents the sealing gaskets 7, 8 and 9, which insulate the inside of the pump from the atmosphere, to be subjected to high pressures which could lead to leakages.

In the foregoing disclosure, it has been made clear that the surface of the rear faces of the flanges on which is exerted the pressure of the delivery duct 26 was greater than the surface of the front face of this flange on which is exerted this same pressure, and it has been indicated that this result was obtained due to the fact that the sealing gasket 49 is subjected to the high pressure.

In order to further increase the differential pressure which has to exist, there is provided that the angle $\alpha$ on which extends each one of the plates 43, 44 from the axis $x_1$, $x_2$, respectively, of the shafts 11 and 16 (FIG. 5) is greater than the angle $\beta$ separating the ends of the incision 48 from the hereabove axes $x_1$, $x_2$.

There is thus obtained that the pressure in the delivery duct 26 is exerted on the rear face of the flanges over a larger angular opening than on the front face.

The invention is not restricted to the embodiment described and shown in detail since various modifications thereof can be applied thereto without departing from its scope as shown in the following claims.

What is claimed is:

1. A hydraulic machine of the gear type, said machine comprising; at least one set of two cooperating pinions rotatably engaged between two bearing flanges said bearing flanges being moveable transverse to the axes of rotation of said at least one set of two cooperating pinions in circular cavities in a median casing closed on the two opposite sides thereof by anterior and posterior covers, each of said two bearing flanges being substantially pressure equilibrated by a sealing system arranged respectively between said of said two bearing flanges and the adjacent cover of said anterior and posterior covers, wherein said bearing flanges (14, 15) supporting said pinions (13, 17) delimit lobes (27, 28) having a same radius of curvature as that of said circular cavities (22, 23) of said median casing (3) containing said bearing flanges, said bearing flanges being partially spaced and floatingly mounted within said median casing (3), and wherein hydraulic pressure means (26) urge said lobes of said bearing flanges (14, 15) against said median casing (3).

2. A machine as set forth in claim 1, wherein said lobes are applied against said median casing (3) through a differential pressure which is provided between a rear face and a front face of said bearing flanges (14, 15), which differential pressure is obtained by providing chambers (46, 47) defined on said front face facing said pinion (13, 17) of each of said bearing flanges to communicate with portions of a rear wall (38) of said bearing flanges defined by a groove (48) and by communicating said chambers and portions of said rear face with an output opening (26) in which is produced a high pressure.

3. A machine as set forth in claim 2, wherein said bearing flanges (14, 15) define cut off portions (29, 30) beyond said lobes, said cut off portions (29, 30) defining spaces (31, 32) providing communication between said chambers (46, 47) and said rear faces of said bearing flanges.

4. A machine as set forth in claim 3, wherein said lobes (27, 28) extend over an arc of a circle which is smaller than 90°.

5. A machine as set forth in claim 3, and comprising studs (33) inserted in said bearing flanges (14, 15), said studs being pressed by springs (36) so as to come to bear against walls of said circular cavities (22, 23) by maintaining said lobes (27, 28) against a portion of said circular cavities corresponding thereto.

6. A machine as set forth in claim 2, wherein said groove (48) in each said rear face of said bearing flanges (14, 15) contains a sealing gasket (49) having small bosses (53) and notches (53*a*) for defining passages for a fluid coming from said output opening (26).

7. A machine as set forth in claim 6, wherein each said sealing gasket (49) exerts a resilient thrust against said cover (1, 2) which is opposite thereto.

8. A machine as set forth in claim 1, wherein a front face of said bearing flanges (14, 15) define annular segments (39, 40) extended by plates. (43, 44) and connected together by a partition wall (45) which is coplanar with said annular segments and plates, forming bearing surfaces for said side faces of said pinions.

9. A machine as set forth in claim 8, wherein said pinions (13, 17) have teeth (41, 42) with a bottom, and wherein said annular segments (39, 40) extend down to said bottom.

10. A machine as set forth in claim 8, wherein said partition wall (45) has a shape corresponding to at least one tooth space (41, 42) of said pinions (13, 17), thereby preventing any direct communication between an inlet opening (25) and an output opening (16).

11. A machine as set forth in claim 1, wherein shafts (11, 16) are provided for supporting said pinions (13, 17), said shafts being mounted in said bearing flanges (14, 15) via bushings or bearings (18, 18*a*, 19, 19*a*) of a width smaller than a thickness of said bearing flanges.

12. A machine as set forth in claim 11, wherein a rear face of said bearing flanges (14, 15) is provided with channels (54, 55) and wherein said bushings (18, 18*a*, 19, 19*a*) have lubrication grooves (20), said channels setting in communication an inlet opening (25) with said lubrication grooves (20).

13. A machine as set forth in claim 11, one (11) of said shafts (11, 16) is connected to an input shaft (11*a*) via a coupling so that forming a primary shaft (11) and a secondary shaft (16) which are subjected to flexural stress.

14. A machine as set forth in claim 11, wherein said shafts (11, 16) are mounted so as to slide axially in said bearing flanges (14, 15).

15. A machine as set forth in claim 8, wherein shafts (11, 16) are provided for supporting said pinions (13, 17), said shafts being mounted in said bearing flanges (14, 15) via bushings or bearings (18, 18*a*, 19, 19*a*) of a width smaller than a thickness of said bearing flanges; wherein a rear face of said bearing flanges (14, 15) is provided with channels (54, 55) and wherein said bushings (18, 18*a*, 19, 19*a*) have lubrication grooves (20), said channels setting in communication an inlet opening (25) with said lubrication grooves (20); and wherein a recess (56) is formed in said front face of said bearing flanges between each of said plates (43, 44) and said partition wall (45) for causing a circulation between said channels (54, 55) and said recess through said lubrication grooves (20) of said bushings and for limiting a friction surface of said pinions.

* * * * *